US011087574B1

(12) United States Patent
Carone

(10) Patent No.: US 11,087,574 B1
(45) Date of Patent: Aug. 10, 2021

(54) MONITORING SYSTEM WITH TRASH CAN INTEGRATION

(71) Applicant: Alarm.com Incorporated, Tysons, VA (US)

(72) Inventor: John Carone, McLean, VA (US)

(73) Assignee: Alarm.com Incorporated, Tysons, VA (US)

( * ) Notice: Subject to any disclaimer, the term of this patent is extended or adjusted under 35 U.S.C. 154(b) by 98 days.

(21) Appl. No.: 16/692,507

(22) Filed: Nov. 22, 2019

Related U.S. Application Data

(60) Provisional application No. 62/776,163, filed on Dec. 6, 2018.

(51) Int. Cl.

| | |
|---|---|
| ***G07C 9/00*** | (2020.01) |
| ***G08B 21/18*** | (2006.01) |
| ***G08B 5/36*** | (2006.01) |
| *E05B 47/00* | (2006.01) |

(52) U.S. Cl.
CPC ..... *G07C 9/00896* (2013.01); *G08B 5/36* (2013.01); *G08B 21/182* (2013.01); *E05B 47/00* (2013.01)

(58) Field of Classification Search
CPC .... G07C 9/00896; G08B 5/36; G08B 21/182; E05B 47/00
See application file for complete search history.

(56) References Cited

U.S. PATENT DOCUMENTS

| | | | | |
|---|---|---|---|---|
| 6,150,939 | A * | 11/2000 | Lin | B65F 1/1426 248/147 |
| 2008/0135558 | A1* | 6/2008 | Udodor | B65F 1/06 220/495.06 |
| 2011/0156903 | A1* | 6/2011 | Henniges | B65F 1/10 340/540 |
| 2012/0037637 | A1* | 2/2012 | Beyda | B65F 1/068 220/495.11 |
| 2013/0248389 | A1* | 9/2013 | Cutler | B65F 1/06 206/216 |
| 2016/0176630 | A1 | 6/2016 | Shahabdeen | |
| 2017/0210559 | A1* | 7/2017 | Howard | B65F 1/1638 |
| 2019/0197498 | A1* | 6/2019 | Gates | H04N 7/181 |
| 2019/0382198 | A1* | 12/2019 | Qiu | B65F 1/16 |

* cited by examiner

*Primary Examiner* — Ojiako K Nwugo
(74) *Attorney, Agent, or Firm* — Fish & Richardson P.C.

(57) ABSTRACT

Methods and systems including computer programs encoded on a computer storage medium, for determining that a trash bag has been removed from a trash can, in response to determining that the trash bag has been removed from the trash can, determining that a door is locked, in response to determining that the door is locked and that the trash bag has been removed from the trash can, unlocking the door, determining that the door has been opened and closed, and in response to determining that the door has been opened and closed, locking the door.

20 Claims, 3 Drawing Sheets

MONITORING SYSTEM WITH TRASH CAN INTEGRATION

CROSS-REFERENCE TO RELATED APPLICATIONS

This application claims the benefit of U.S. Provisional Application No. 62/776,163, filed Dec. 6, 2018, which is incorporated by reference in its entirety.

TECHNICAL FIELD

This disclosure relates to property monitoring technology.

BACKGROUND

Many people equip homes and businesses with monitoring systems to provide increased security for their homes and businesses. In these same homes and businesses trash cans are commonly used to store trash.

SUMMARY

Techniques are described for monitoring technology with trash can integration. Many homes and businesses are equipped with monitoring systems to provide security. For example, the monitoring systems may control locks, detect unauthorized intrusions, and generate event alerts. Additionally, homes and businesses generally include trash cans to store trash. For example, a home may include a trash can in a kitchen that is used by people to store trash. The trash can may be periodically emptied. For example, a trash can in a kitchen may store trash in a trash bag and, when the trash bag is full, a person may remove the trash bag from the trash can and throw the bag into an outdoor trash can.

In some implementations, a trash can may be integrated with a monitoring system of a property to provide greater functionality to the monitoring system. Functionality may include automatic unlocking and locking of doors. For example, a monitoring system may receive an indication from an indoor trash can that a trash bag has been removed, determine that a door that is used when trash is moved from the indoor trash can to an outdoor trash can is currently locked, and in response, unlock the door. Then, a monitoring system may determine that the door was opened after the trash bag was removed, then closed, and, in response, lock the door. Accordingly, the system may provide greater convenience to people within the property as a door does not need to be manually unlocked and locked.

Additionally or alternatively, the system may automatically turn on an outdoor light near an outdoor trash can in response to the indoor trash indicating that a trash bag has been removed, and then automatically turn off the outdoor light when the door is opened and closed. Accordingly, the system may provide greater visibility and safety when a person is moving trash from an indoor trash can to an outdoor trash can. Similarly, the system may open or close a garage door when the indoor trash can indicates a trash bag has been removed.

The indoor trash can may provide additional advantages. For example, the indoor trash can may indicate to a person one or more of whether an object that the person is throwing away should be recycled, an object isn't empty so may still be used, a replacement for the object should be purchased, or the trash can is full. In some implementations, the indoor trash can may be used to trigger a fan to reduce smell.

Implementations of the described techniques may include hardware, a method or process implemented at least partially in hardware, or a computer-readable storage medium encoded with executable instructions that, when executed by a processor, perform operations.

The details of one or more implementations are set forth in the accompanying drawings and the description below. Other features will be apparent from the description and drawings, and from the claims.

DESCRIPTION OF DRAWINGS

Like reference symbols in the various drawings indicate like elements.

DETAILED DESCRIPTION

Figure 1:
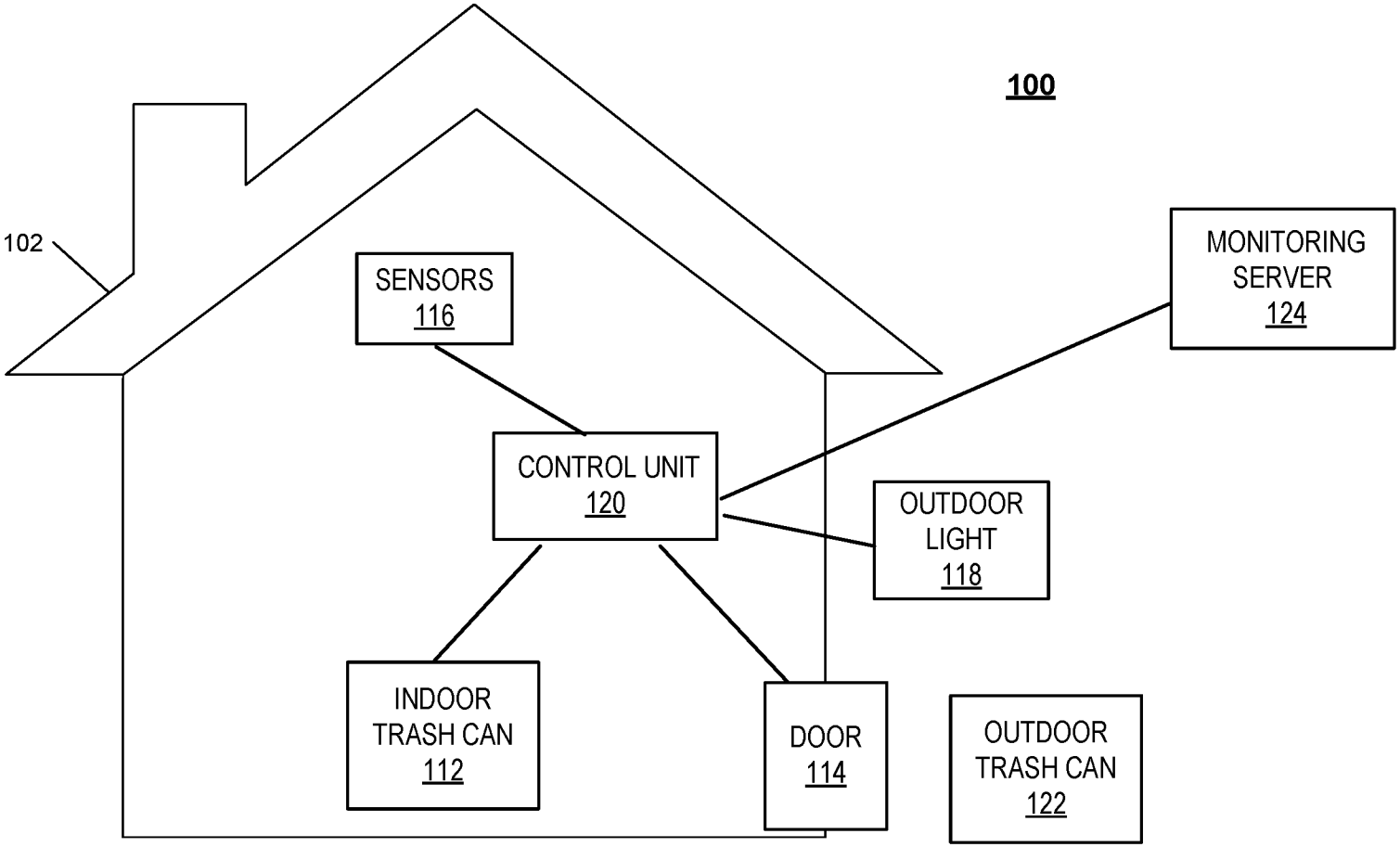
FIG. 1 illustrates an example of a monitoring system with trash can integration.

FIG. 1 illustrates an example of a monitoring system 100 with trash can integration. As shown in FIG. 1, the system 100 may include a property 102 (e.g. a home) of a user that is monitored, an indoor trash can 112, a door 114, sensors 116, an outdoor light 118, a control unit 120, an outdoor trash can 122, and a monitoring server 124.

The indoor trash can 112 may be a trash can that is configured to store trash and provide an indication when trash is removed. For example, the indoor trash can 112 may be rectangular box shaped with a lid on top that may be opened and closed. The indoor trash can 112 may include a pressure sensor that detects when the indoor trash can 112 includes trash and when the indoor trash can 112 doesn't include trash. For example, the pressure sensor may be located at a bottom of the indoor trash can 112 and indicate a weight of objects on the pressure sensor. In some implementations, the weight may be indicated by a numerical amount that represents the total weight of the objects, e.g., 0.5, 1.3, 2.4 pounds. Additionally or alternatively, the weight may be indicated by a binary indication of whether the total weight of objects satisfies a threshold. For example, a total weight less than 0.3 pounds indicated by "empty" and a total weight of 0.3 pounds or greater indicated by "not empty."

Additionally or alternatively, the indoor trash can 112 may include a volume sensor that detects when the indoor trash can 112 includes trash and when the indoor trash can 112 doesn't include trash based on a volume of trash. For example, the volume sensor may be used to detect that the indoor trash can 112 is empty, 20% full, 80% full, or over capacity. The volume sensor may include one or more of a light based sensor that detects whether one or more light beams are broken by objects or a radar based sensor that detects reflections of radar off objects.

The door 114 may include a lock, that may be electronically controlled by the control unit 120 to lock or unlock the door 114, and a sensor that indicates whether the door 114 is open or closed. For example, the door 114 may be a back door between a kitchen where the indoor trash can 112 is located and an outdoor area where an outdoor trash can 122 is located, where when a person removes a trash bag from the indoor trash can 112, the person typically opens the door 114, throws the trash bag into the outdoor trash can 122, then returns inside the kitchen through the door 114, and closes the door 114 after returning.

The sensors 116 may be used to sense the presence of people within the property 102. For example, the sensors 116 may include a passive infrared (PIR) sensor within a kitchen that senses when a kitchen is occupied by at least one person. Additionally or alternatively, the sensors 116 may include a camera with a view of inside the kitchen where video from the camera can be analyzed to determine whether a person is in the kitchen.

The outdoor light 118 may be a light that is located outside the property 102 which may be electronically controlled by the control unit 120 to turn on and off. For example, the outdoor light 118 may be located near the outdoor trash can 122 and may be turned on when a person is throwing away trash so that the person can see better.

The control unit 120 may receive information from the indoor trash can 112, the sensors 116, the door 114, and the outdoor light 118 to control unlocking and locking of the door 114 and turning on and off the outdoor light 118. For example, as described in greater detail in regards to FIG. 2, the control unit 120 may receive an indication from the indoor trash can 112 that a trash bag has been removed from the indoor trash can 112 and the indoor trash can 112 was almost full, an indication from the sensors 116 that a person is present near the indoor trash can 112. Then, it may determine that the door 114 is locked, the outdoor light 118 is off and it's night time, in response, unlock the door 114 and turn on the outdoor light 118, determine that the door 114 has been opened and then closed, and, in response, lock the door 114 and turn off the outdoor light 118.

The monitoring server 124 may be located remotely from the property 102 and may perform some or all the functionality described for the control unit 120. For example, the control unit 120 may route information from the indoor trash can 112, door 114, sensors 116, and outdoor light 118 to the monitoring server 124 for the monitoring server 124 to provide instructions for the door 114 and the outdoor light 118 to be routed by the control unit 120.

In some implementations, the indoor trash can 112 may include a camera where the camera provides a view and the control unit 120 may use an indication of presence of a person based on the view of the camera of the indoor trash can 112. Additionally or alternatively, the indoor trash can 112 may include a PIR sensor that indicates whether a person is present near the indoor trash can 112 and the control unit 120 may use the indication of presence of a person from the PIR sensor of the indoor trash can 112.

In some implementations, the indoor trash can 112 may perform classification of objects to determine whether the objects should be recycled. For example, the indoor trash can 112 may include a camera and recognize objects in the field of view of the camera, and determine from a set of recycling rules whether the object should be recycled. If the indoor trash can 112 determines the object should be recycled, the object may be automatically sorted into a recycling portion of the indoor trash can 112, and if not, the object may be automatically sorted into a trash portion of the indoor trash can 112. Alternatively, in some implementations, instead of automatically sorting, the indoor trash can 112 may provide an indication to a person that an object is recyclable or trash, e.g., outputting audio of "recyclable" or displaying a recycle symbol on a display screen of the indoor trash can 112, so that the person can then place the object appropriately.

The indoor trash can 112 may perform recognition of objects through optical character recognition (OCR), pattern recognition image comparison, or bar code reading. For example, the indoor trash can 112 may use OCR to recognize that an object is a box that includes the text "Cereal A," in response, classify the object as a cardboard box for Cereal A, and then classify the object as recyclable as cardboard boxes are recyclable. In another example, the indoor trash can 112 may use image comparison to determine that an object is a box that includes a logo of "Cereal A," in response, classify the object as a cardboard box for Cereal A, and then classify the object as recyclable as cardboard boxes are recyclable.

In some implementations, the indoor trash can 112 may indicate that a property 102 is out of a type of object or an object needs to be purchased. For example, the indoor trash can 112 may classify an object being thrown away as a box for "Cereal A" and, in response, provide a notification to all persons that reside in the property 102 that a replacement box for "Cereal A" should be purchased.

In some implementations, the indoor trash can 112 may indicate whether an object being thrown away isn't empty so a person may decide whether the object should actually be thrown away. For example, the indoor trash can 112 may know that an empty box for "Cereal A" weighs 0.2 ounces. The pressure sensor in the indoor trash can 112 may determine that the total weight of objects in the indoor trash can 112 increased from 0.8 ounces to 1.2 ounces when a box for "Cereal A" was thrown away, determine that the weight increase of 0.4 ounces is greater than the known empty box weight of 0.2 ounces so the box wasn't empty, and, in response, provide an indication to a person that the object wasn't empty.

In some implementations, the indoor trash can 112 may include multiple cameras to obtain different views of objects at different angles to better recognize objects. In some implementations, the indoor trash can 112 may obtain recycling rules from the Internet so that the recycling rules may be up to date. Additionally or alternatively, the indoor trash can 112 may determine where the indoor trash can 112 is located and identify appropriate recycling rules for the location. For example, the indoor trash can 112 may include a global positioning satellite (GPS) sensor, obtain GPS coordinates using the GPS sensor, determine a county that includes the GPS coordinates, and then identify recycling rules for the county.

In some implementations, the system 100 may also be used to control fans within the property 102 to reduce odor from trash within the indoor trash can 112. The control unit 120 may determine that trash is likely to be causing odor. For example, the control unit 120 may determine that trash is likely to be causing odor in response to determining that the lid of the indoor trash can 112 remains at least partially open, determining a volume of trash in the indoor trash can 112 is greater than 80%, 90%, or some other percentage, determine at least some trash within the indoor trash can 112 has remained within the indoor trash can 112 for at least a predetermined amount of time, e.g., three or four days, or determine from an odor sensor that odor sensed satisfies an odor threshold. In response, the control unit 120 may turn on a fan near the indoor trash can 112. The control unit 120 may turn on the fan based on turning on all fans, identify a fan closest to the indoor trash can 112 and turn on that fan, or identifying fans within a predetermined distance from the indoor trash can 112 and turning on the identified fans.

In some implementations, the system 100 may also notify a user or raise an alarm if the indoor trash can 112 indicates that trash has been added or removed, or it has been opened while the user is not at the property 102. For example, someone that is not supposed to be in the property 102 may use the indoor trash can 112 at some point and the system 100 may detect this and provide an alert to a user that the indoor trash can 112 detected that trash was added or removed, or it was opened while no one was supposed to be in the property 102.

Some of the implementations described above may instead be performed by the control unit 120, the monitoring server 124, or a combination of one or more of the indoor trash can 112, control unit 120, and the monitoring server 124. For example, the control unit 120 may obtain video from the sensors 116 and the indoor trash can 112 to recognize objects and indicate the recognized object to the monitoring server 124 for the monitoring server 124 to then determine whether the object should be recycled according to recycling rules, and the control unit 120 may then receive an indication whether the object should be recycled from the monitoring server 124 and provide that indication to the indoor trash can 112.

Figure 2:
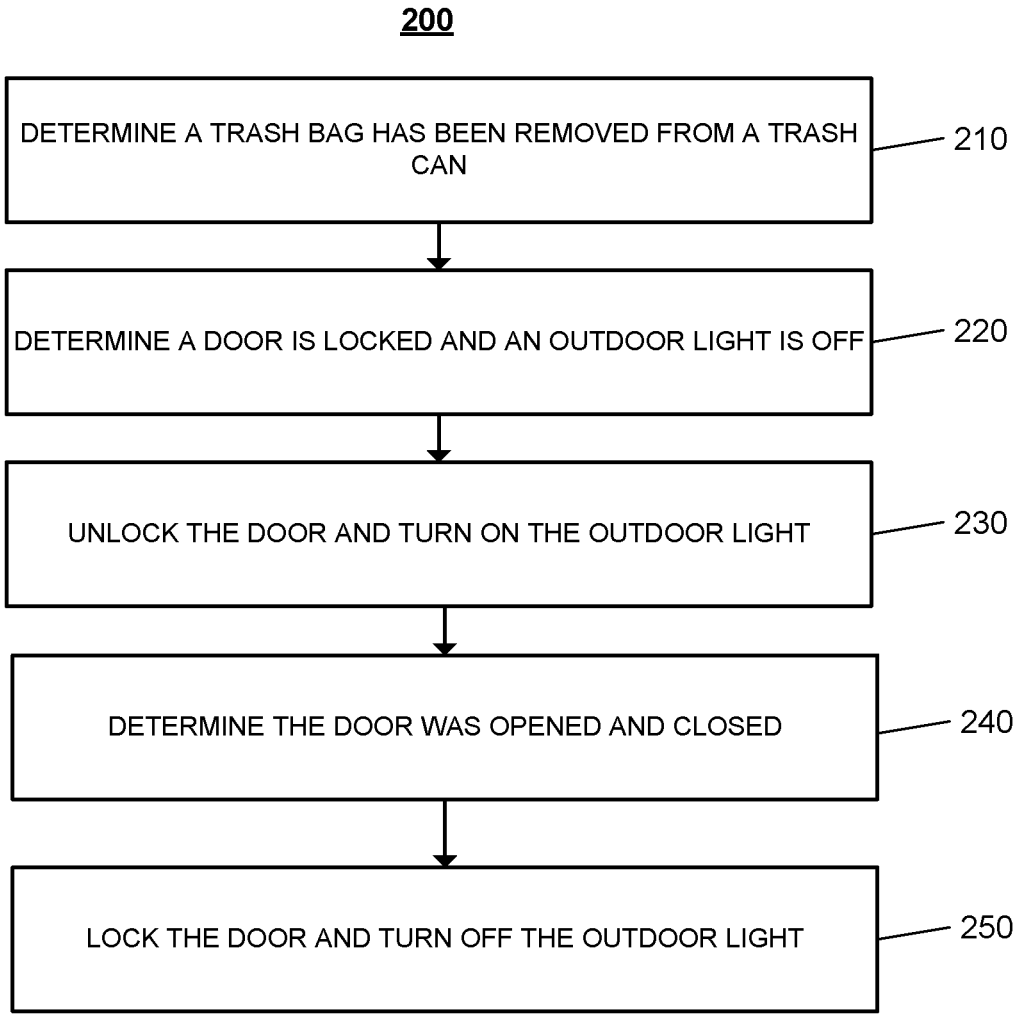
FIG. 2 is a flow chart of an example process for a monitoring system with trash can integration.

FIG. 2 illustrates an example process 200 for a monitoring system with trash can integration. The process 200 may be implemented using system 100 described above or other systems.

The process 200 includes determining that a trash bag has been removed from a trash can (210). For example, the control unit 120 may determine that a trash bag has been removed from the indoor trash can 112. In some implementations, the control unit 120 may determine that a trash bag has been removed from the trash can in response to determining that the indoor trash can 112 indicated a total weight of objects stored in the indoor trash can 112 satisfies an empty weight threshold and that most previously the indoor trash can 112 indicated a total weight of objects stored in the indoor trash can 112 that does not satisfy the empty weight threshold.

For example, the control unit 120 may determine that the indoor trash can 112 indicated a total weight of 0.3 pounds and that weight is less than an empty threshold of 0.5 pounds so satisfies the empty threshold, and that the indoor trash can 112 previously indicated a total weight of 2.5 pounds and that weight was greater than the empty threshold of 0.5 pounds. In some implementations, determining that a weight of objects stored in the trash can satisfies an empty weight threshold is based on a scale included in the trash can that weights objects stored in the trash can. For example, the indoor trash can 112 includes a scale that determines a total weight of 2.5 pounds for all objects stored in the trash can.

In some other implementations, the control unit 120 may determine that a trash bag has been removed from the trash can in response to determining that the indoor trash can 112 indicated a total weight of objects stored in the indoor trash can 112 that does not satisfy a non-empty weight threshold and that most previously the indoor trash can 112 indicated a total weight of objects stored in the indoor trash can 112 that satisfied the non-empty weight threshold.

In some implementations, the control unit 120 may determine that a trash bag has been removed from the trash can in response to determining that the indoor trash can 112 indicated a volume of objects stored in the indoor trash can 112 satisfies an empty volume threshold and that most previously the indoor trash can 112 indicated a volume of objects stored in the indoor trash can 112 that does not satisfy the empty volume threshold. For example, the control unit 120 may determine that the indoor trash can 112 indicated a volume of 5% and that volume is less than an empty volume threshold of 10% so satisfies the empty volume threshold, and that the indoor trash can 112 previously indicated a volume of 80% and that volume was greater than the empty volume threshold of 10%.

In some other implementations, the control unit 120 may determine that a trash bag has been removed from the trash can in response to determining that the indoor trash can 112 indicated a total volume of objects stored in the indoor trash can 112 that does not satisfy a non-empty volume threshold and that most previously the indoor trash can 112 indicated a total volume of objects stored in the indoor trash can 112 that satisfied the non-empty volume threshold.

In some implementations, the control unit 120 may additionally determine that a trash bag has been removed from the indoor trash can 112 based on also determining that a person is present in the property 102. For example, the control unit 120 may determine that the sensors 116 indicate that a person is present in the property 102 so that someone could have possibly removed the trash bag from the indoor trash can 112.

In some implementations, the control unit 120 may additionally determine that a trash bag has been removed from the indoor trash can 112 based on determining that a person is near the indoor trash can 112. In some implementations, determining that a trash bag has been removed from a trash can includes determining, with a passive infrared sensor in the trash can, that a person is near the trash can when a volume or weight of objects stored in the trash satisfies a threshold. For example, the control unit 120 may determine that a PIR sensor in the indoor trash can 112 indicates a person is near the indoor trash can 112 when the indoor trash can 112 determined that a weight or volume of objects stored in the indoor trash can 112 began to satisfy an empty threshold. Determining that a person is present in the property 102 or near the indoor trash can 112 may help avoid performing actions when a pressure sensor or volume sensor of the indoor trash can 112 malfunctions.

Accordingly, the control unit 120 may determine that an indoor trash can 112 indicated that a weight satisfied a non-empty threshold and then satisfies an empty threshold, in response determine whether a person is present in the property 102, and, in response to determining that a person is not present, determine that a trash bag was not removed. Similarly, the control unit 120 may determine that an indoor trash can 112 indicated that a weight satisfied a non-empty threshold and then satisfies an empty threshold, in response determine whether a person is present in the property 102, and, in response to determining that a person is present, determine that a trash bag was removed.

The process 200 includes determining if a door is locked and an outdoor light is off (220). For example, the control unit 120 may determine that the door 114 is locked and the outdoor light 118 is off. The control unit 120 may determine a door is locked and an outdoor light is off in response to determining that the trash bag has been removed from the trash can.

The process 200 includes unlocking the door and turning on the outdoor light (230). For example, in response to determining that the trash bag has been removed from the trash can and that the door 114 is locked and the outdoor light 118 is off, the control unit 120 may instruct the door 114 to unlock and the outdoor light 118 to turn on.

The process 200 includes determining that the door was opened and closed (240). The control unit 120 may determine that the door was opened and closed since the trash bag was removed from the trash can. The opening and closing of the door may indicate that a person has brought the trash bag outside from the property 102, thrown it into an outdoor trash can, and then returned into the property 102.

The process 200 includes locking the door and turning off the outdoor light (250). For example, in response to determining that the door was opened and closed since the trash bag was removed from the trash can, the control unit 120 may instruct the door 114 to lock and the outdoor light to turn on 118.

In some implementations, a door may be determined to be locked and an outdoor light may be determined to be on. Accordingly, the door may be unlocked and the outdoor light kept on and when the door is determined to opened and closed, the door may be locked and the outdoor light kept on. Accordingly, the door and outdoor light may return to how they were before the trash bag was removed.

In some implementations, a door may be determined to be unlocked and an outdoor light may be determined to be off. Accordingly, the door may be left unlocked and the outdoor light turned on and when the door is determined to opened and closed, the door may be kept unlocked and the outdoor light turned off. Accordingly, the door and outdoor light may return to how they were before the trash bag was removed.

Additionally or alternative processes to process 200 may be used. For example, a process may only unlock and lock a door and not turn on and off an outdoor light. Such a process may include, similarly to as described above, determining that a trash bag has been removed from a trash can, determining that a door is locked, unlocking the door, determining that the door was opened and closed, and locking the door. In some implementations, a process may determine whether it is night time and only if is night time determine whether to turn on and off an outdoor light. In another example, a process may only turn on and off an outdoor light and not unlock and lock a door. Such a process may include, similarly to as described above, determining that a trash bag has been removed from a trash can, determining that an outdoor light is off, turning the outdoor light on, determining that the door was opened and closed, and turning off the light.

In yet another example, a process may include in response to determining that the trash bag has been removed from the trash can, determining that a current time corresponds to night time and an outdoor light is off, in response to determining that the current time corresponds to night time and the outdoor light is off, turning on the outdoor light, determining that the door was opened and closed, and in response to determining that the door was opened and closed, turning off the outdoor light. For example, the control unit 120 may determine that a trash bag was removed from the trash can based on receiving, from the indoor trash can 112, an indication of total weights of objects, in response to determining that the trash bag was removed from the trash can, determine that on the particular day the sun sets at 7:00 PM and it is currently 8:00 PM so it is nighttime and that the outdoor light 118 has been set to an off state, in response, turn on the outdoor light 118, receive indications from a door sensor coupled to the door 114 that the door was opened and then closed, and, in response, turn off the outdoor light 118.

In some implementations, a process may be used where a garage is opened and closed in response to a trash bag being removed from a trash can. For example, the trash bag may be moved to a trash can inside a garage that is separate from a building in which the indoor trash can is located. Such a process may include, similarly to as described above, determining that a trash bag has been removed from a trash can, opening a garage door, determining that a door of the building in which the trash can is located was opened and closed, and, in response, closing the garage door. Control of the garage door may be done in addition to control of a door of the building in which the indoor trash can is located and/or control of the outdoor light.

In some implementations, a process may include, instead of locking the door and/or turning off a light in response to determining that a door is closed after opening, determining that one, two, five, minutes or some other amount of time has elapsed since the door was unlocked and/or light turned on and, in response, locking the door and/or turning off the light.

Figure 3:
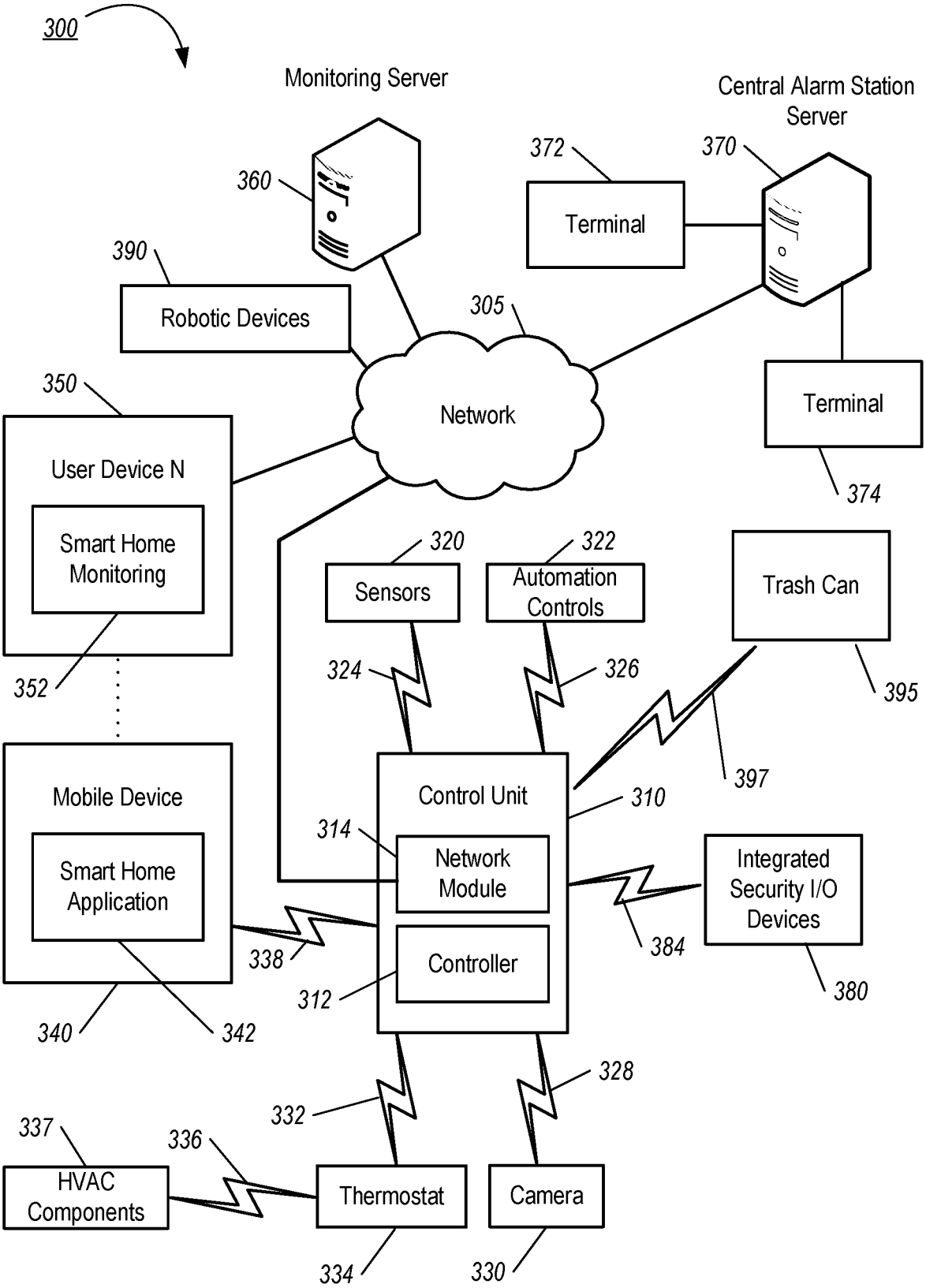
FIG. 3 is another example of a monitoring system with trash can integration.

FIG. 3 is a diagram illustrating an example of a home monitoring system 300. The monitoring system 300 includes a network 305, a control unit 310, one or more user devices 340 and 350, a monitoring server 360, and a central alarm station server 370. In some examples, the network 305 facilitates communications between the control unit 310, the one or more user devices 340 and 350, the monitoring server 360, and the central alarm station server 370.

The network 305 is configured to enable exchange of electronic communications between devices connected to the network 305. For example, the network 305 may be configured to enable exchange of electronic communications between the control unit 310, the one or more user devices 340 and 350, the monitoring server 360, and the central alarm station server 370. The network 305 may include, for example, one or more of the Internet, Wide Area Networks (WANs), Local Area Networks (LANs), analog or digital wired and wireless telephone networks (e.g., a public switched telephone network (PSTN), Integrated Services Digital Network (ISDN), a cellular network, and Digital Subscriber Line (DSL)), radio, television, cable, satellite, or any other delivery or tunneling mechanism for carrying data. Network 305 may include multiple networks or subnetworks, each of which may include, for example, a wired or wireless data pathway. The network 305 may include a circuit-switched network, a packet-switched data network, or any other network able to carry electronic communications (e.g., data or voice communications). For example, the network 305 may include networks based on the Internet protocol (IP), asynchronous transfer mode (ATM), the PSTN, packet-switched networks based on IP, X.25, or Frame Relay, or other comparable technologies and may support voice using, for example, VoIP, or other comparable protocols used for voice communications. The network 305 may include one or more networks that include wireless data channels and wireless voice channels. The network 305 may be a wireless network, a broadband network, or a combination of networks including a wireless network and a broadband network.

The control unit 310 includes a controller 312 and a network module 314. The controller 312 is configured to control a control unit monitoring system (e.g., a control unit system) that includes the control unit 310. In some examples, the controller 312 may include a processor or other control circuitry configured to execute instructions of a program that controls operation of a control unit system. In these examples, the controller 312 may be configured to receive input from sensors, flow meters, or other devices included in the control unit system and control operations of devices included in the household (e.g., speakers, lights, doors, etc.). For example, the controller 312 may be configured to control operation of the network module 314 included in the control unit 310.

The network module 314 is a communication device configured to exchange communications over the network 305. The network module 314 may be a wireless communication module configured to exchange wireless communications over the network 305. For example, the network module 314 may be a wireless communication device configured to exchange communications over a wireless data channel and a wireless voice channel. In this example, the network module 314 may transmit alarm data over a wireless data channel and establish a two-way voice communication session over a wireless voice channel. The wireless communication device may include one or more of a LTE module, a GSM module, a radio modem, cellular transmission module, or any type of module configured to exchange communications in one of the following formats: LTE, GSM or GPRS, CDMA, EDGE or EGPRS, EV-DO or EVDO, UMTS, or IP.

The network module 314 also may be a wired communication module configured to exchange communications over the network 305 using a wired connection. For instance, the network module 314 may be a modem, a network interface card, or another type of network interface device. The network module 314 may be an Ethernet network card configured to enable the control unit 310 to communicate over a local area network and/or the Internet. The network module 314 also may be a voice band modem configured to enable the alarm panel to communicate over the telephone lines of Plain Old Telephone Systems (POTS).

The control unit system that includes the control unit 310 includes one or more sensors. For example, the monitoring system may include multiple sensors 320. The sensors 320 may include a lock sensor, a contact sensor, a motion sensor, or any other type of sensor included in a control unit system. The sensors 320 also may include an environmental sensor, such as a temperature sensor, a water sensor, a rain sensor, a wind sensor, a light sensor, a smoke detector, a carbon monoxide detector, an air quality sensor, etc. The sensors 320 further may include a health monitoring sensor, such as a prescription bottle sensor that monitors taking of prescriptions, a blood pressure sensor, a blood sugar sensor, a bed mat configured to sense presence of liquid (e.g., bodily fluids) on the bed mat, etc. In some examples, the health-monitoring sensor can be a wearable sensor that attaches to a user in the home. The health-monitoring sensor can collect various health data, including pulse, heart rate, respiration rate, sugar or glucose level, bodily temperature, or motion data.

The sensors 320 can also include a radio-frequency identification (RFID) sensor that identifies a particular article that includes a pre-assigned RFID tag.

The control unit 310 communicates with the home automation controls 322 and a camera 330 to perform monitoring. The home automation controls 322 are connected to one or more devices that enable automation of actions in the home. For instance, the home automation controls 322 may be connected to one or more lighting systems and may be configured to control operation of the one or more lighting systems. In addition, the home automation controls 322 may be connected to one or more electronic locks at the home and may be configured to control operation of the one or more electronic locks (e.g., control Z-Wave locks using wireless communications in the Z-Wave protocol). Further, the home automation controls 322 may be connected to one or more appliances at the home and may be configured to control operation of the one or more appliances. The home automation controls 322 may include multiple modules that are each specific to the type of device being controlled in an automated manner. The home automation controls 322 may control the one or more devices based on commands received from the control unit 310. For instance, the home automation controls 322 may cause a lighting system to illuminate an area to provide a better image of the area when captured by a camera 330.

The camera 330 may be a video/photographic camera or other type of optical sensing device configured to capture images. For instance, the camera 330 may be configured to capture images of an area within a building or home monitored by the control unit 310. The camera 330 may be configured to capture single, static images of the area and also video images of the area in which multiple images of the area are captured at a relatively high frequency (e.g., thirty images per second). The camera 330 may be controlled based on commands received from the control unit 310.

The camera 330 may be triggered by several different types of techniques. For instance, a Passive Infra-Red (PIR) motion sensor may be built into the camera 330 and used to trigger the camera 330 to capture one or more images when motion is detected. The camera 330 also may include a microwave motion sensor built into the camera and used to trigger the camera 330 to capture one or more images when motion is detected. The camera 330 may have a "normally open" or "normally closed" digital input that can trigger capture of one or more images when external sensors (e.g., the sensors 320, PIR, door/window, etc.) detect motion or other events. In some implementations, the camera 330 receives a command to capture an image when external devices detect motion or another potential alarm event. The camera 330 may receive the command from the controller 312 or directly from one of the sensors 320.

In some examples, the camera 330 triggers integrated or external illuminators (e.g., Infra-Red, Z-wave controlled "white" lights, lights controlled by the home automation controls 322, etc.) to improve image quality when the scene is dark. An integrated or separate light sensor may be used to determine if illumination is desired and may result in increased image quality.

The camera 330 may be programmed with any combination of time/day schedules, system "arming state", or other variables to determine whether images should be captured or not when triggers occur. The camera 330 may enter a low-power mode when not capturing images. In this case, the camera 330 may wake periodically to check for inbound messages from the controller 312. The camera 330 may be powered by internal, replaceable batteries if located remotely from the control unit 310. The camera 330 may employ a small solar cell to recharge the battery when light is available. Alternatively, the camera 330 may be powered by the controller's 312 power supply if the camera 330 is co-located with the controller 312.

In some implementations, the camera 330 communicates directly with the monitoring server 360 over the Internet. In these implementations, image data captured by the camera 330 does not pass through the control unit 310 and the camera 330 receives commands related to operation from the monitoring server 360.

The system 300 also includes thermostat 334 to perform dynamic environmental control at the home. The thermostat 334 is configured to monitor temperature and/or energy consumption of an HVAC system associated with the thermostat 334, and is further configured to provide control of environmental (e.g., temperature) settings. In some implementations, the thermostat 334 can additionally or alternatively receive data relating to activity at a home and/or environmental data at a home, e.g., at various locations indoors and outdoors at the home. The thermostat 334 can directly measure energy consumption of the HVAC system associated with the thermostat, or can estimate energy consumption of the HVAC system associated with the thermostat 334, for example, based on detected usage of one or more components of the HVAC system associated with the thermostat 334. The thermostat 334 can communicate temperature and/or energy monitoring information to or from the control unit 310 and can control the environmental (e.g., temperature) settings based on commands received from the control unit 310.

In some implementations, the thermostat 334 is a dynamically programmable thermostat and can be integrated with the control unit 310. For example, the dynamically programmable thermostat 334 can include the control unit 310, e.g., as an internal component to the dynamically programmable thermostat 334. In addition, the control unit 310 can be a gateway device that communicates with the dynamically programmable thermostat 334. In some implementations, the thermostat 334 is controlled via one or more home automation controls 322.

A module 337 is connected to one or more components of an HVAC system associated with a home, and is configured to control operation of the one or more components of the HVAC system. In some implementations, the module 337 is also configured to monitor energy consumption of the HVAC system components, for example, by directly measuring the energy consumption of the HVAC system components or by estimating the energy usage of the one or more HVAC system components based on detecting usage of components of the HVAC system. The module 337 can communicate energy monitoring information and the state of the HVAC system components to the thermostat 334 and can control the one or more components of the HVAC system based on commands received from the thermostat 334.

In some examples, the system 300 further includes one or more robotic devices 390. The robotic devices 390 may be any type of robots that are capable of moving and taking actions that assist in home monitoring. For example, the robotic devices 390 may include drones that are capable of moving throughout a home based on automated control technology and/or user input control provided by a user. In this example, the drones may be able to fly, roll, walk, or otherwise move about the home. The drones may include helicopter type devices (e.g., quad copters), rolling helicopter type devices (e.g., roller copter devices that can fly and roll along the ground, walls, or ceiling) and land vehicle type devices (e.g., automated cars that drive around a home). In some cases, the robotic devices 390 may be devices that are intended for other purposes and merely associated with the system 300 for use in appropriate circumstances. For instance, a robotic vacuum cleaner device may be associated with the monitoring system 300 as one of the robotic devices 390 and may be controlled to take action responsive to monitoring system events.

In some examples, the robotic devices 390 automatically navigate within a home. In these examples, the robotic devices 390 include sensors and control processors that guide movement of the robotic devices 390 within the home. For instance, the robotic devices 390 may navigate within the home using one or more cameras, one or more proximity sensors, one or more gyroscopes, one or more accelerometers, one or more magnetometers, a global positioning system (GPS) unit, an altimeter, one or more sonar or laser sensors, and/or any other types of sensors that aid in navigation about a space. The robotic devices 390 may include control processors that process output from the various sensors and control the robotic devices 390 to move along a path that reaches the desired destination and avoids obstacles. In this regard, the control processors detect walls or other obstacles in the home and guide movement of the robotic devices 390 in a manner that avoids the walls and other obstacles.

In addition, the robotic devices 390 may store data that describes attributes of the home. For instance, the robotic devices 390 may store a floorplan and/or a three-dimensional model of the home that enables the robotic devices 390 to navigate the home. During initial configuration, the robotic devices 390 may receive the data describing attributes of the home, determine a frame of reference to the data (e.g., a home or reference location in the home), and navigate the home based on the frame of reference and the data describing attributes of the home. Further, initial configuration of the robotic devices 390 also may include learning of one or more navigation patterns in which a user provides input to control the robotic devices 390 to perform a specific navigation action (e.g., fly to an upstairs bedroom and spin around while capturing video and then return to a home charging base). In this regard, the robotic devices 390 may learn and store the navigation patterns such that the robotic devices 390 may automatically repeat the specific navigation actions upon a later request.

In some examples, the robotic devices 390 may include data capture and recording devices. In these examples, the robotic devices 390 may include one or more cameras, one or more motion sensors, one or more microphones, one or more biometric data collection tools, one or more temperature sensors, one or more humidity sensors, one or more air flow sensors, and/or any other types of sensors that may be useful in capturing monitoring data related to the home and users in the home. The one or more biometric data collection tools may be configured to collect biometric samples of a person in the home with or without contact of the person. For instance, the biometric data collection tools may include a fingerprint scanner, a hair sample collection tool, a skin cell collection tool, and/or any other tool that allows the robotic devices 390 to take and store a biometric sample that can be used to identify the person (e.g., a biometric sample with DNA that can be used for DNA testing).

In some implementations, the robotic devices 390 may include output devices. In these implementations, the robotic devices 390 may include one or more displays, one or more speakers, and/or any type of output devices that allow the robotic devices 390 to communicate information to a nearby user.

The robotic devices 390 also may include a communication module that enables the robotic devices 390 to communicate with the control unit 310, each other, and/or other devices. The communication module may be a wireless communication module that allows the robotic devices 390 to communicate wirelessly. For instance, the communication module may be a Wi-Fi module that enables the robotic devices 390 to communicate over a local wireless network at the home. The communication module further may be a 900 MHz wireless communication module that enables the robotic devices 390 to communicate directly with the control unit 310. Other types of short-range wireless communication protocols, such as Bluetooth, Bluetooth LE, Z-wave, Zigbee, etc., may be used to allow the robotic devices 390 to communicate with other devices in the home. In some implementations, the robotic devices 390 may communicate with each other or with other devices of the system 300 through the network 305.

The robotic devices 390 further may include processor and storage capabilities. The robotic devices 390 may include any suitable processing devices that enable the robotic devices 390 to operate applications and perform the actions described throughout this disclosure. In addition, the robotic devices 390 may include solid-state electronic storage that enables the robotic devices 390 to store applications, configuration data, collected sensor data, and/or any other type of information available to the robotic devices 390.

The robotic devices 390 are associated with one or more charging stations. The charging stations may be located at predefined home base or reference locations in the home. The robotic devices 390 may be configured to navigate to the charging stations after completion of tasks needed to be performed for the monitoring system 300. For instance, after completion of a monitoring operation or upon instruction by the control unit 310, the robotic devices 390 may be configured to automatically fly to and land on one of the charging stations. In this regard, the robotic devices 390 may automatically maintain a fully charged battery in a state in which the robotic devices 390 are ready for use by the monitoring system 300.

The charging stations may be contact based charging stations and/or wireless charging stations. For contact based charging stations, the robotic devices 390 may have readily accessible points of contact that the robotic devices 390 are capable of positioning and mating with a corresponding contact on the charging station. For instance, a helicopter type robotic device may have an electronic contact on a portion of its landing gear that rests on and mates with an electronic pad of a charging station when the helicopter type robotic device lands on the charging station. The electronic contact on the robotic device may include a cover that opens to expose the electronic contact when the robotic device is charging and closes to cover and insulate the electronic contact when the robotic device is in operation.

For wireless charging stations, the robotic devices 390 may charge through a wireless exchange of power. In these cases, the robotic devices 390 need only locate themselves closely enough to the wireless charging stations for the wireless exchange of power to occur. In this regard, the positioning needed to land at a predefined home base or reference location in the home may be less precise than with a contact based charging station. Based on the robotic devices 390 landing at a wireless charging station, the wireless charging station outputs a wireless signal that the robotic devices 390 receive and convert to a power signal that charges a battery maintained on the robotic devices 390.

In some implementations, each of the robotic devices 390 has a corresponding and assigned charging station such that the number of robotic devices 390 equals the number of charging stations. In these implementations, the robotic devices 390 always navigate to the specific charging station assigned to that robotic device. For instance, a first robotic device may always use a first charging station and a second robotic device may always use a second charging station.

In some examples, the robotic devices 390 may share charging stations. For instance, the robotic devices 390 may use one or more community charging stations that are capable of charging multiple robotic devices 390. The community charging station may be configured to charge multiple robotic devices 390 in parallel. The community charging station may be configured to charge multiple robotic devices 390 in serial such that the multiple robotic devices 390 take turns charging and, when fully charged, return to a predefined home base or reference location in the home that is not associated with a charger. The number of community charging stations may be less than the number of robotic devices 390.

In addition, the charging stations may not be assigned to specific robotic devices 390 and may be capable of charging any of the robotic devices 390. In this regard, the robotic devices 390 may use any suitable, unoccupied charging station when not in use. For instance, when one of the robotic devices 390 has completed an operation or is in need of battery charge, the control unit 310 references a stored table of the occupancy status of each charging station and instructs the robotic device to navigate to the nearest charging station that is unoccupied.

The system 300 further includes one or more integrated security devices 380. The one or more integrated security devices may include any type of device used to provide alerts based on received sensor data. For instance, the one or more control units 310 may provide one or more alerts to the one or more integrated security input/output devices 380. Additionally, the one or more control units 310 may receive one or more sensor data from the sensors 320 and determine whether to provide an alert to the one or more integrated security input/output devices 380.

The sensors 320, the home automation controls 322, the camera 330, the thermostat 334, and the integrated security devices 380 may communicate with the controller 312 over communication links 324, 326, 328, 332, 338, and 384. The communication links 324, 326, 328, 332, 338, and 384 may be a wired or wireless data pathway configured to transmit signals from the sensors 320, the home automation controls 322, the camera 330, the thermostat 334, and the integrated security devices 380 to the controller 312. The sensors 320, the home automation controls 322, the camera 330, the thermostat 334, and the integrated security devices 380 may continuously transmit sensed values to the controller 312, periodically transmit sensed values to the controller 312, or transmit sensed values to the controller 312 in response to a change in a sensed value.

The communication links 324, 326, 328, 332, 338, and 384 may include a local network. The sensors 320, the home automation controls 322, the camera 330, the thermostat 334, and the integrated security devices 380, and the controller 312 may exchange data and commands over the local network. The local network may include 802.11 "Wi-Fi" wireless Ethernet (e.g., using low-power Wi-Fi chipsets), Z-Wave, Zigbee, Bluetooth, "Homeplug" or other "Powerline" networks that operate over AC wiring, and a Category 5 (CAT5) or Category 6 (CAT6) wired Ethernet network. The local network may be a mesh network constructed based on the devices connected to the mesh network.

The monitoring server 360 is an electronic device configured to provide monitoring services by exchanging electronic communications with the control unit 310, the one or more user devices 340 and 350, and the central alarm station server 370 over the network 305. For example, the monitoring server 360 may be configured to monitor events generated by the control unit 310. In this example, the monitoring server 360 may exchange electronic communications with the network module 314 included in the control unit 310 to receive information regarding events detected by the control unit 310. The monitoring server 360 also may receive information regarding events from the one or more user devices 340 and 350.

In some examples, the monitoring server 360 may route alert data received from the network module 314 or the one or more user devices 340 and 350 to the central alarm station server 370. For example, the monitoring server 360 may transmit the alert data to the central alarm station server 370 over the network 305.

The monitoring server 360 may store sensor and image data received from the monitoring system and perform analysis of sensor and image data received from the monitoring system. Based on the analysis, the monitoring server 360 may communicate with and control aspects of the control unit 310 or the one or more user devices 340 and 350.

The monitoring server 360 may provide various monitoring services to the system 300. For example, the monitoring server 360 may analyze the sensor, image, and other data to determine an activity pattern of a resident of the home monitored by the system 300. In some implementations, the monitoring server 360 may analyze the data for alarm conditions or may determine and perform actions at the home by issuing commands to one or more of the controls 322, possibly through the control unit 310.

The monitoring server 360 can be configured to provide information (e.g., activity patterns) related to one or more residents of the home monitored by the system 300 (e.g., user 108). For example, one or more of the sensors 320, the home automation controls 322, the camera 330, the thermostat 334, and the integrated security devices 380 can collect data related to a resident including location information (e.g., if the resident is home or is not home) and provide location information to the thermostat 334.

The central alarm station server 370 is an electronic device configured to provide alarm monitoring service by exchanging communications with the control unit 310, the one or more user devices 340 and 350, and the monitoring server 360 over the network 305. For example, the central alarm station server 370 may be configured to monitor alerting events generated by the control unit 310. In this example, the central alarm station server 370 may exchange communications with the network module 314 included in the control unit 310 to receive information regarding alerting events detected by the control unit 310. The central alarm station server 370 also may receive information regarding alerting events from the one or more user devices 340 and 350 and/or the monitoring server 360.

The central alarm station server 370 is connected to multiple terminals 372 and 374. The terminals 372 and 374 may be used by operators to process alerting events. For example, the central alarm station server 370 may route alerting data to the terminals 372 and 374 to enable an operator to process the alerting data. The terminals 372 and 374 may include general-purpose computers (e.g., desktop personal computers, workstations, or laptop computers) that are configured to receive alerting data from a server in the central alarm station server 370 and render a display of information based on the alerting data. For instance, the controller 312 may control the network module 314 to transmit, to the central alarm station server 370, alerting data indicating that a sensor 320 detected motion from a motion sensor via the sensors 320. The central alarm station server 370 may receive the alerting data and route the alerting data to the terminal 372 for processing by an operator associated with the terminal 372. The terminal 372 may render a display to the operator that includes information associated with the alerting event (e.g., the lock sensor data, the motion sensor data, the contact sensor data, etc.) and the operator may handle the alerting event based on the displayed information.

In some implementations, the terminals 372 and 374 may be mobile devices or devices designed for a specific function. Although FIG. 3 illustrates two terminals for brevity, actual implementations may include more (and, perhaps, many more) terminals.

The one or more authorized user devices 340 and 350 are devices that host and display user interfaces. For instance, the user device 340 is a mobile device that hosts or runs one or more native applications (e.g., the home monitoring application 342). The user device 340 may be a cellular phone or a non-cellular locally networked device with a display. The user device 340 may include a cell phone, a smart phone, a tablet PC, a personal digital assistant ("PDA"), or any other portable device configured to communicate over a network and display information. For example, implementations may also include Blackberry-type devices (e.g., as provided by Research in Motion), electronic organizers, iPhone-type devices (e.g., as provided by Apple), iPod devices (e.g., as provided by Apple) or other portable music players, other communication devices, and handheld or portable electronic devices for gaming, communications, and/or data organization. The user device 340 may perform functions unrelated to the monitoring system, such as placing personal telephone calls, playing music, playing video, displaying pictures, browsing the Internet, maintaining an electronic calendar, etc.

The user device 340 includes a home monitoring application 352. The home monitoring application 342 refers to a software/firmware program running on the corresponding mobile device that enables the user interface and features described throughout. The user device 340 may load or install the home monitoring application 342 based on data received over a network or data received from local media. The home monitoring application 342 runs on mobile devices platforms, such as iPhone, iPod touch, Blackberry, Google Android, Windows Mobile, etc. The home monitoring application 342 enables the user device 340 to receive and process image and sensor data from the monitoring system.

The user device 340 may be a general-purpose computer (e.g., a desktop personal computer, a workstation, or a laptop computer) that is configured to communicate with the monitoring server 360 and/or the control unit 310 over the network 305. The user device 340 may be configured to display a smart home user interface 352 that is generated by the user device 340 or generated by the monitoring server 360. For example, the user device 340 may be configured to display a user interface (e.g., a web page) provided by the monitoring server 360 that enables a user to perceive images captured by the camera 330 and/or reports related to the monitoring system. Although FIG. 3 illustrates two user devices for brevity, actual implementations may include more (and, perhaps, many more) or fewer user devices.

In some implementations, the one or more user devices 340 and 350 communicate with and receive monitoring system data from the control unit 310 using the communication link 338. For instance, the one or more user devices 340 and 350 may communicate with the control unit 310 using various local wireless protocols such as Wi-Fi, Bluetooth, Z-wave, Zigbee, HomePlug (ethernet over power line), or wired protocols such as Ethernet and USB, to connect the one or more user devices 340 and 350 to local security and automation equipment. The one or more user devices 340 and 350 may connect locally to the monitoring system and its sensors and other devices. The local connection may improve the speed of status and control communications because communicating through the network 305 with a remote server (e.g., the monitoring server 360) may be significantly slower.

Although the one or more user devices 340 and 350 are shown as communicating with the control unit 310, the one or more user devices 340 and 350 may communicate directly with the sensors and other devices controlled by the control unit 310. In some implementations, the one or more user devices 340 and 350 replace the control unit 310 and perform the functions of the control unit 310 for local monitoring and long range/offsite communication.

In other implementations, the one or more user devices 340 and 350 receive monitoring system data captured by the control unit 310 through the network 305. The one or more user devices 340, 350 may receive the data from the control unit 310 through the network 305 or the monitoring server 360 may relay data received from the control unit 310 to the one or more user devices 340 and 350 through the network 305. In this regard, the monitoring server 360 may facilitate communication between the one or more user devices 340 and 350 and the monitoring system.

In some implementations, the one or more user devices 340 and 350 may be configured to switch whether the one or more user devices 340 and 350 communicate with the control unit 310 directly (e.g., through link 338) or through the monitoring server 360 (e.g., through network 305) based on a location of the one or more user devices 340 and 350. For instance, when the one or more user devices 340 and 350 are located close to the control unit 310 and in range to communicate directly with the control unit 310, the one or more user devices 340 and 350 use direct communication. When the one or more user devices 340 and 350 are located far from the control unit 310 and not in range to communicate directly with the control unit 310, the one or more user devices 340 and 350 use communication through the monitoring server 360.

Although the one or more user devices 340 and 350 are shown as being connected to the network 305, in some implementations, the one or more user devices 340 and 350 are not connected to the network 305. In these implementations, the one or more user devices 340 and 350 communicate directly with one or more of the monitoring system components and no network (e.g., Internet) connection or reliance on remote servers is needed.

In some implementations, the one or more user devices 340 and 350 are used in conjunction with only local sensors and/or local devices in a house. In these implementations, the system 300 includes the one or more user devices 340 and 350, the sensors 320, the home automation controls 322, the camera 330, and the robotic devices 390. The one or more user devices 340 and 350 receive data directly from the sensors 320, the home automation controls 322, the camera 330, and the robotic devices 390, and sends data directly to the sensors 320, the home automation controls 322, the camera 330, and the robotic devices 390. The one or more user devices 340, 350 provide the appropriate interfaces/processing to provide visual surveillance and reporting.

In other implementations, the system 300 further includes network 305 and the sensors 320, the home automation controls 322, the camera 330, the thermostat 334, and the robotic devices 390, and are configured to communicate sensor and image data to the one or more user devices 340 and 350 over network 305 (e.g., the Internet, cellular network, etc.). In yet another implementation, the sensors 320, the home automation controls 322, the camera 330, the thermostat 334, and the robotic devices 390 (or a component, such as a bridge/router) are intelligent enough to change the communication pathway from a direct local pathway when the one or more user devices 340 and 350 are in close physical proximity to the sensors 320, the home automation controls 322, the camera 330, the thermostat 334, and the robotic devices 390 to a pathway over network 305 when the one or more user devices 340 and 350 are farther from the sensors 320, the home automation controls 322, the camera 330, the thermostat 334, and the robotic devices 390.

In some examples, the system leverages GPS information from the one or more user devices 340 and 350 to determine whether the one or more user devices 340 and 350 are close enough to the sensors 320, the home automation controls 322, the camera 330, the thermostat 334, and the robotic devices 390 to use the direct local pathway or whether the one or more user devices 340 and 350 are far enough from the sensors 320, the home automation controls 322, the camera 330, the thermostat 334, and the robotic devices 390 that the pathway over network 305 is required.

In other examples, the system leverages status communications (e.g., pinging) between the one or more user devices 340 and 350 and the sensors 320, the home automation controls 322, the camera 330, the thermostat 334, and the robotic devices 390 to determine whether communication using the direct local pathway is possible. If communication using the direct local pathway is possible, the one or more user devices 340 and 350 communicate with the sensors 320, the home automation controls 322, the camera 330, the thermostat 334, and the robotic devices 390 using the direct local pathway. If communication using the direct local pathway is not possible, the one or more user devices 340 and 350 communicate with the sensors 320, the home automation controls 322, the camera 330, the thermostat 334, and the robotic devices 390 using the pathway over network 305.

In some implementations, the system 300 provides end users with access to images captured by the camera 330 to aid in decision making. The system 300 may transmit the images captured by the camera 330 over a wireless WAN network to the user devices 340 and 350. Because transmission over a wireless WAN network may be relatively expensive, the system 300 can use several techniques to reduce costs while providing access to significant levels of useful visual information (e.g., compressing data, down-sampling data, sending data only over inexpensive LAN connections, or other techniques).

In some implementations, a state of the monitoring system and other events sensed by the monitoring system may be used to enable/disable video/image recording devices (e.g., the camera 330). In these implementations, the camera 330 may be set to capture images on a periodic basis when the alarm system is armed in an "away" state, but set not to capture images when the alarm system is armed in a "home" state or disarmed. In addition, the camera 330 may be triggered to begin capturing images when the alarm system detects an event, such as an alarm event, a door-opening event for a door that leads to an area within a field of view of the camera 330, or motion in the area within the field of view of the camera 330. In other implementations, the camera 330 may capture images continuously, but the captured images may be stored or transmitted over a network when needed.

The system 300 further includes a trash can 395 in communication with the control unit 310 through a communication link 397, which similarly to as described above in regards to communication links 324, 326, 328, 332, 338, and 384, may be wired or wireless and include a local network. The trash can 395 may be the indoor trash can 112, the control unit 310 may be the control unit 120, the sensors 320 may include the sensors 116, the automation controls 322 may include the door 114 and the outdoor light 118, and the monitoring server 360 may be the monitoring server 124.

The described systems, methods, and techniques may be implemented in digital electronic circuitry, computer hardware, firmware, software, or in combinations of these elements. Apparatus implementing these techniques may include appropriate input and output devices, a computer processor, and a computer program product tangibly embodied in a machine-readable storage device for execution by a programmable processor. A process implementing these techniques may be performed by a programmable processor executing a program of instructions to perform desired functions by operating on input data and generating appropriate output. The techniques may be implemented in one or more computer programs that are executable on a programmable system including at least one programmable processor coupled to receive data and instructions from, and to transmit data and instructions to, a data storage system, at least one input device, and at least one output device. Each computer program may be implemented in a high-level procedural or object-oriented programming language, or in assembly or machine language if desired; and in any case, the language may be a compiled or interpreted language. Suitable processors include, by way of example, both general and special purpose microprocessors. Generally, a processor will receive instructions and data from a read-only memory and/or a random access memory. Storage devices suitable for tangibly embodying computer program instructions and data include all forms of non-volatile memory, including by way of example semiconductor memory devices, such as Erasable Programmable Read-Only Memory (EPROM), Electrically Erasable Programmable Read-Only Memory (EEPROM), and flash memory devices; magnetic disks such as internal hard disks and removable disks; magneto-optical disks; and Compact Disc Read-Only Memory (CD-ROM). Any of the foregoing may be supplemented by, or incorporated in, specially-designed ASICs (application-specific integrated circuits).

It will be understood that various modifications may be made. For example, other useful implementations could be achieved if steps of the disclosed techniques were performed in a different order and/or if components in the disclosed systems were combined in a different manner and/or replaced or supplemented by other components. Accordingly, other implementations are within the scope of the disclosure.

What is claimed is:

1. A computer-implemented method comprising:

determining that a trash bag has been removed from a trash can;

in response to determining that the trash bag has been removed from the trash can, determining that a door is locked;

in response to determining that the door is locked and that the trash bag has been removed from the trash can, unlocking the door;

determining that the door has been opened and closed; and in response to determining that the door has been opened and closed, locking the door.

2. The method of claim 1, wherein determining that a trash bag has been removed from a trash can comprises:

determining that a weight of objects stored in the trash can satisfies an empty weight threshold and that previously the trash can indicated a weight of objects stored in the trash can that did not satisfy the empty weight threshold.

3. The method of claim 2, wherein determining that a weight of objects stored in the trash can satisfies an empty weight threshold is based on a scale included in the trash can that weights objects stored in the trash can.

4. The method of claim 1, wherein determining that a weight of objects stored in the trash can satisfies an empty weight threshold comprises:

determining that the weight of objects stored in the trash can is below an empty weight threshold.

5. The method of claim 1, wherein determining that a trash bag has been removed from a trash can is in response to determining that the trash can indicated a total weight of objects stored in the trash can that does not satisfy a non-empty weight threshold and that most previously the trash can indicated a total weight of objects stored in the trash can that satisfied the non-empty weight threshold.

6. The method of claim 1, wherein determining that a trash bag has been removed from a trash can comprises:

determining that a volume of objects stored in the trash can satisfies an empty volume threshold and that previously the trash can indicated a volume of objects stored in the trash can that did not satisfy the empty volume threshold.

7. The method of claim 1, wherein determining that a trash bag has been removed from a trash can comprises:

determining, with a passive infrared sensor in the trash can, that a person is near the trash can when a volume or weight of objects stored in the trash satisfies a threshold.

8. The method of claim 1, wherein determining that a door is locked comprises:

determining that a door sensor coupled to the door indicated that the door is locked.

9. The method of claim 1, wherein comprises:

in response to determining that the trash bag has been removed from the trash can, determining that a current time corresponds to night time and an outdoor light is off;

in response to determining that the current time corresponds to night time and the outdoor light is off, turning on the outdoor light;

determining that the door was opened and closed; and in response to determining that the door was opened and closed, turning off the outdoor light.

10. A system comprising:

one or more computers and one or more storage devices storing instructions that are operable, when executed by the one or more computers, to cause the one or more computers to perform operations comprising:

determining that a trash bag has been removed from a trash can;

in response to determining that the trash bag has been removed from the trash can, determining that a door is locked;

in response to determining that the door is locked and that the trash bag has been removed from the trash can, unlocking the door;

determining that the door has been opened and closed; and in response to determining that the door has been opened and closed, locking the door.

11. The system of claim 10, wherein determining that a trash bag has been removed from a trash can comprises:

determining that a weight of objects stored in the trash can satisfies an empty weight threshold and that previously the trash can indicated a weight of objects stored in the trash can that did not satisfy the empty weight threshold.

12. The system of claim 11, wherein determining that a weight of objects stored in the trash can satisfies an empty weight threshold is based on a scale included in the trash can that weights objects stored in the trash can.

13. The system of claim 10, wherein determining that a weight of objects stored in the trash can satisfies an empty weight threshold comprises:

determining that the weight of objects stored in the trash can is below an empty weight threshold.

14. The system of claim 10, wherein determining that a trash bag has been removed from a trash can is in response to determining that the trash can indicated a total weight of objects stored in the trash can that does not satisfy a non-empty weight threshold and that most previously the trash can indicated a total weight of objects stored in the trash can that satisfied the non-empty weight threshold.

15. The system of claim 10, wherein determining that a trash bag has been removed from a trash can comprises:

determining that a volume of objects stored in the trash can satisfies an empty volume threshold and that previously the trash can indicated a volume of objects stored in the trash can that did not satisfy the empty volume threshold.

16. The system of claim 10, wherein determining that a trash bag has been removed from a trash can comprises:

determining, with a passive infrared sensor in the trash can, that a person is near the trash can when a volume or weight of objects stored in the trash satisfies a threshold.

17. The system of claim 10, wherein determining that a door is locked comprises:

determining that a door sensor coupled to the door indicated that the door is locked.

18. The system of claim 10, wherein comprises:

in response to determining that the trash bag has been removed from the trash can, determining that a current time corresponds to night time and an outdoor light is off;

in response to determining that the current time corresponds to night time and the outdoor light is off, turning on the outdoor light;

determining that the door was opened and closed; and in response to determining that the door was opened and closed, turning off the outdoor light.

19. A non-transitory computer-readable medium storing software comprising instructions executable by one or more computers which, upon such execution, cause the one or more computers to perform operations comprising:

determining that a trash bag has been removed from a trash can;

in response to determining that the trash bag has been removed from the trash can, determining that a door is locked;

in response to determining that the door is locked and that the trash bag has been removed from the trash can, unlocking the door;

determining that the door has been opened and closed; and in response to determining that the door has been opened and closed, locking the door.

20. The medium of claim 19, wherein determining that a trash bag has been removed from a trash can comprises:

determining that a weight of objects stored in the trash can satisfies an empty weight threshold and that previously the trash can indicated a weight of objects stored in the trash can that did not satisfy the empty weight threshold.

* * * * *